US006112851A

United States Patent [19]

Sugimoto et al.

[11] Patent Number: 6,112,851

[45] Date of Patent: Sep. 5, 2000

[54] PARTITION WALL PANEL

[75] Inventors: Akio Sugimoto; Narikazu Hashimoto, both of Kobe; Shusei Arakane, Tokyo; Kenji Iwai, Tokyo; Tadayuki Minoura, Tokyo, all of Japan

[73] Assignee: Kobe Steel, Ltd., Kobe, Japan

[21] Appl. No.: 09/416,955

[22] Filed: Oct. 13, 1999

[30] Foreign Application Priority Data

Oct. 14, 1998 [JP] Japan ..... 10-292524

[51] Int. Cl.[7] ..... E04B 1/343

[52] U.S. Cl. ..... 181/287; 181/286

[58] Field of Search ..... 181/287, 286, 181/284, 288, 290, 291, 295

[56] References Cited

U.S. PATENT DOCUMENTS 5,975,238 11/1999 Fuchs et al. ..... 181/286

FOREIGN PATENT DOCUMENTS 5-150789 6/1993 Japan .
6-26126 2/1994 Japan .
6-221061 8/1994 Japan .
9-100600 4/1997 Japan .

*Primary Examiner*—Khanh Dang
*Attorney, Agent, or Firm*—Oblon, Spivak, McClelland, Maier & Neustadt, P.C.

[57] ABSTRACT

In a partition wall panel of the present invention, a panel is formed by arranging a plurality of plates at an interval in the direction of the thickness of the plates and by joining the plates along at least part of the peripheries of the plates or/and at part of the surfaces of the plates using a joint member, and a plurality of such panels are integrated while arranged side by side through a plurality of air layers, and connected along at least part of the peripheries thereof or/and at part of the surfaces thereof using a connecting member. As a result of this construction, a thin, light-weight, and highly sound-insulating multi-layered panel structure can be provided.

18 Claims, 10 Drawing Sheets

PARTITION WALL PANEL

BACKGROUND OF THE INVENTION

1. Field of the Invention

The present invention relates to a multi-layered panel structure used as a partition wall for partitioning a large indoor space into several spaces.

2. Description of the Related Art

While partition walls are roughly divided in two types, fixed and movable, most of them are constructed by attaching face members, such as steel plates 12 and gypsum boards 13, to both surfaces of a metallic frame member 11, e.g., as shown in FIG. 18.

In order to improve the sound insulation performance of such a partition wall, measures are taken to increase the thickness of the gypsum board or to attach two gypsum boards to one side of the frame member for increasing the mass per unit area of the face member. Further, in order to suppress the coincidence phenomenon in which sound insulation performance decreases at the frequency higher than critical coincidence frequency fc that is calculated by the equation (1) shown below from the mass per unit area: m and the bending rigidity B of a face member, an example is disclosed, in which a measure is taken to attach a damping material to the inner side of a face member (see Japanese Patent Laid-Open Application No. Hei 6-221061, being hereby fully incorporated by reference).

$$fc=(C^2/2\pi)\times(m/B)^{1/2} \quad (1)$$

where C is the velocity of sound in air.

Further, in order to suppress the low-frequency resonance transmission phenomenon in which sound insulation performance decreases by the vibrations caused at one of two face members being transmitted to the other as a result of the air layer interposed between the two face members acting as a pneumatic spring, a measure is taken to use glass wool to fill in the space between the two face members (see, e.g., Japanese Utility Model Laid-Open Application No. Sho 51-154030, being hereby fully incorporated by reference). Still further, for a movable partition wall for which a high sound insulation performance is particularly required, there is an example in which two partition walls are installed about 1 m apart from each other.

Although the sound insulation performance of a wall can be increased by increasing the mass per unit area of a face member, the wall becomes heavier and hard to install. Further, if the wall is of a movable type, it is hard to move the wall manually and thus entails much time and labor to set it up. Still further, even if the mass per unit areais, e.g., doubled, the sound insulation performance can be improved by 5 dB at most.

On the other hand, when two partition walls, each exhibiting a sound insulation performance of, e.g., 30 dB at 500 Hz, are installed about 1 m apart from each other as a double-installed wall, a sound insulation performance of about 60 dB can be obtained. However, such double-installed wall design requires not only twice as large a space for installing the walls, but also twice as large ancillary facilities such as rails for moving the partition walls. Therefore, if sufficient installation space is not available or if there are restrictions on expenditure, such double-installed wall design cannot be adopted.

SUMMARY OF THE INVENTION

An object of the present invention is to provide a thin, light-weight, and highly sound-insulating multi-layered panel structure.

The present invention provides a partition wall panel which is constructed by using a panel formed by arranging a plurality of plates at an interval in the direction of the thickness of the plates and joining the plates along at least part of the peripheries of the plates or/and at part of the surfaces of the plates using a joint member, and by integrating a plurality of such panels while arranging the panels side by side through a plurality of air layers, and connecting the panels along at least part of the peripheries of the panels or/and at part of the surfaces of the panels using a connecting member.

Note that the words "join and joint" and "connect and connecting" are not used to particularly mean different things. Further, the joint member and the connecting member may include any member that is made independently of the plate or integrally with the plate (by bending ends of the plate). Still further, in the aforementioned multi-layered panel structure, it is desirable to cause the joint member to joint the plates along part or all of the peripheries extending along the sides of the plates and cause the connecting member to connect the panels along part or all of the peripheries extending along the sides of the panels. However, the joining and connecting methods are not limited to this example.

In the aforementioned multi-layered panel structure, when it is defined that the X axis extends in the direction of a side of a plate constituting the panel; the Y axis extends in parallel with the surface of the plate and in the direction right angles to the X axis; the Z axis extends perpendicular to the surface of the plate; translational springs in the X, Y, and Z directions are Kx, Ky and Kz; and rotary springs in the same directions are Kθx, Kθy and Kθz as shown in FIG. 2, it is desirable to set the rotary spring constant Kθx of the joint member whose rotary axis is the X axis to a value smaller than the translational springs (Kx, Ky, Kz) and the rotary springs (Kθy, Kθz) in all the other directions, or/and when it is defined that the X axis extends in the direction of a side of a panel; the Y axis extends in parallel with the surface of the panel and in the direction right angels to the X axis; the Z axis extends perpendicular to the surface of the panel; translational springs in the X, Y, and Z directions are Kx, Ky and Kz; and rotary springs in the same directions are Kθx, Kθy and Kθz as shown in FIG. 2, it is desirable to set the rotary spring constant Kθx of the connecting member whose rotary axis is the X axis to a value smaller than the translational springs (Kx, Ky, Kz) and the rotary springs (Kθy, Kθz) in all the other directions.

Further, in the aforementioned multi-layered panel structure, it is desirable to set the rotary spring constant of the connecting member whose rotary axis extends in the direction of the side of the panel to a value smaller than the rotary spring constant of the joint member whose axis extends in the same direction, or to set the rotary spring constant of the joint member whose rotary axis extends in the direction of the side of the plate to a value smaller than the rotary spring constant of the connecting member whose rotary axis extends in the same direction.

BRIEF DESCRIPTION OF THE DRAWINGS

FIGS. 1A to 1C are perspective views showing an example of a multi-layered panel structure according to the present invention, wherein FIG. 1A is an exploded view of the general structure, FIG. 1B is a view of another example of a connecting member, and FIG. 1C is a view of another example of a joint member;

FIGS. 6A and 6B are sectional views showing the joint structure of the respective panel segments for forming the panel structure of FIG. 5, wherein FIG. 6A shows a state before the panel segments are fitted and FIG. 6B a state after the panel segments are fitted;

FIGS. 8A and 8B are sectional views showing the joint structure of the respective multi-layered panel structural bodies for forming the panel structure of FIG. 7, wherein FIG. 8A shows a state before the panel structural bodies are fitted and FIG. 8B a state after the panel structural bodies are fitted;

DETAILED DESCRIPTION OF THE PREFERRED EMBODIMENTS

Embodiments of the present invention will now be described with reference to FIGS. 1A to 17. When a plurality of plates are arranged at an interval in the direction of their thickness, or more specifically, when two 1-mm-thick steel plates, each exhibiting a sound insulation performance of about 20 dB at 500 Hz, are arranged a sufficiently large distance apart from each other, a sound insulation performance of about 40 dB is obtained. Thus, when a plurality of plates are arranged a sufficiently large distance apart from each other, the sound insulation performance that equals the value obtained by multiplying the sound insulation performance of a single plate with the number of such plates is obtained, and this is a well known fact. On the other hand, the present invention has been successful in providing a thin panel structural body with a high sound insulation performance through such a basic construction as "a multi-layered panel structure in which a plurality of panels, each obtained by joining a plurality of plates along at least part of the peripheries of the plates or/and at part of their surfaces using a joint member, are arranged side by side through air layers, and the plurality of such panels are integrated by connecting such panels along at least part of the peripheries of the panels or/and at part of their surfaces using a connecting member or connecting members."

Figure 1C:
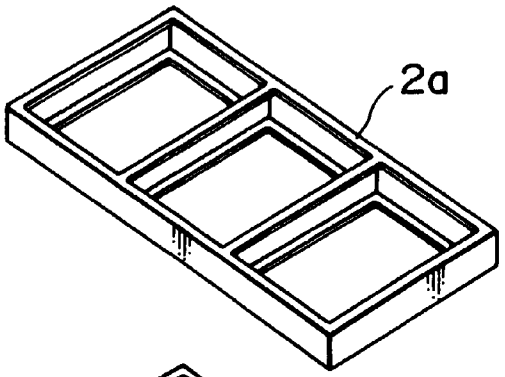
Figure 1B:
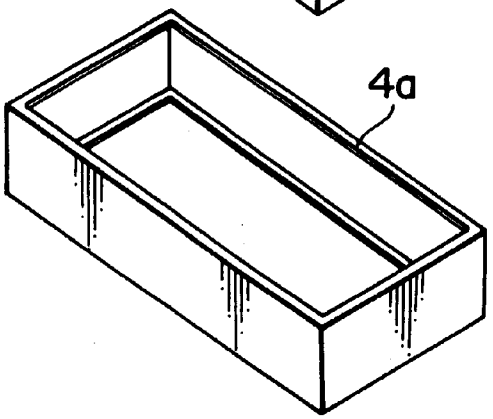
Figure 1A:
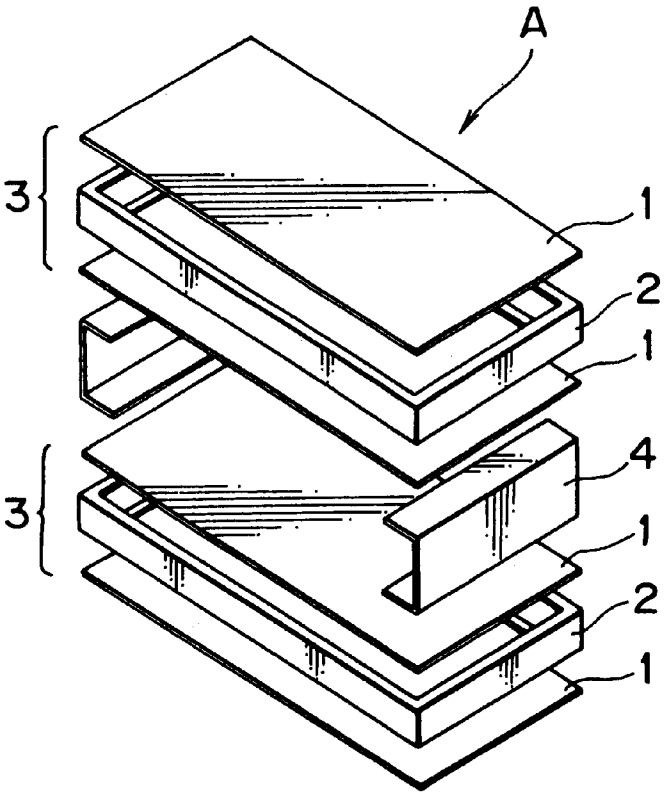

FIG. 1A shows an example of the aforementioned multi-layered panel structure. A panel 3 is constructed by arranging two rectangular plates 1 at an interval in the direction of their thickness and by joining the plates 1 along their peripheries using a joint member 2. Two such panels 3 are connected using connecting members 4. Here, the joint member 2 is a rectangular frame-like body having a U-shaped cross section which herein after means a cross section just like one of the connecting member 4 of FIG. 1A, and joins the two plates 1 and 1 together along their entire peripheries to thereby form the panel 3. The connecting member 4 is U-shaped in cross section, and connects the two panels 3 along part of their peripheries, i.e., along their shorter sides. The plate 1, the joint member 2, and the connecting member 4 may be made of various materials including metals (steel, aluminum and the like) and plastics. Further, the methods by which the joint member 2 and the plates 1 are joined and by which the connecting members 4 and the panels 3 are connected may include any appropriate means such as adhesion, welding, bolting, pin-coupling, and any combination thereof.

In the multi-layered panel structure A shown in FIG. 1A, the peripheral portions on the longer sides of each panel 3 are not closed by the connecting members 4. In place of such connecting members 4 through which the panels 3 are connected only along part of their peripheries, a frame-like integrated connecting member 4*a*, such as shown in FIG. 1B, through which the panels 3 are connected all along their peripheries, or a connecting member through which the panels 3 are connected all along their peripheries and at part of their surfaces (the part being other than the peripheries of the panels) (e.g., a joint member 2*a*, such as shown in FIG. 1C, through which the panels are connected all along their peripheries and at part of their surfaces) may also be used. Further, the joint member 2 for forming the panel 3 is a frame-like body through which the plates 1 are joined together all along their peripheries. In place of such joint member 2, a joint member through which the plates 1 are joined along only part of their peripheries (e.g., a joint member through which the plates 1 are joined only along their shorter side like the connecting member 4), or the joint member 2*a*, such as shown in FIG. 1C, through which the plates 1 are joined all along their peripheries and at part of their surfaces may also be used. Still further, not only the joint members and the connecting members through which the plates 1 or the panels 3 are joined along their peripheries as described above, but also a joint member through which the plates 1 are joined only over their surfaces or a connecting member through which the panels 3 are connected only over their surfaces may also be used.

While the aforementioned joint and connecting members have an opened (or U-shaped) cross section when vertically cut along their length, they may also have other cross sections, such as a closed (e.g., box-shaped) cross section.

Note that an ordinary partition is used with its longer sides erect and its shorter sides opposed to the ceiling wall and the floor. In addition, a plurality of partitions are usually used while arranged together contiguously planewise with no gap. Therefore, there is no need for their longer sides to be closed (or it would be rather preferable to leave at least part of their sides opened, and this will be detailed later). The same applies to the formation of the panel 3, and thus the plates 1 constituting the panel 3 may not necessarily be joined along the peripheral portions of their longer sides through the joint member. Further, if a partition is arranged contiguously, e.g., with both the ceiling wall and the floor with no gap, the shorter sides of the multi-layered panel structure (the peripheries of the shorter sides of the panel 3 and/or the plate 1) may not necessarily be closed, either.

In the aforementioned multi-layered panel structure A, each panel 3 has the following sound insulation performance. When the distance between which the two plates 1 and 1 are arranged is short and the rotary spring constant (see FIG. 2; a rotary spring is Kθx with the X direction being the longitudinal direction of each side of the joint member) of the joint member 2 whose rotary axis extends in the direction of a side of the plate 1 (the longitudinal direction of the joint member) is large, the bending moment produced by the bending vibrations at the peripheral portion of one of the plates (the vibrations caused at such plate by incident sound wave) is transmitted to the other plate by the rotary spring of the joint member 2 through the joint member 2. Further, the air layer formed between the plates 1 and 1 acts as a pneumatic spring, and the vibrations caused at such one of the plates are transmitted to the other plate through the air. Since the vibrations at one plate are transmitted to the other through the joint member 2 and the pneumatic spring as described above, the sound insulation performance of the panel 3 is expressed in terms of a value lower than that obtained by simply multiplying (doubling) the sound insulation performance of a single plate with the number of such plates.

Figure 2:
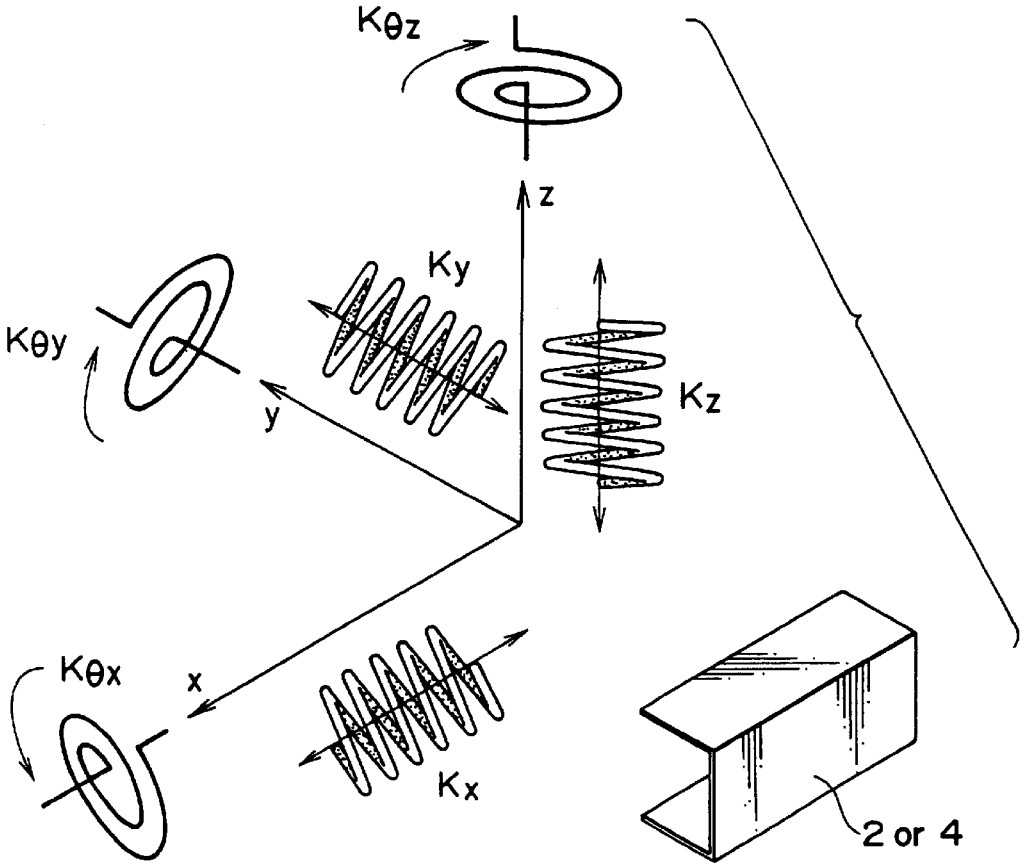
FIG. 2 is a diagram for illustrating translational springs and rotary springs in axial directions when the longitudinal direction of each side of the joint member and the connecting member is designated as the X axis.
Figures 3A, 3B:
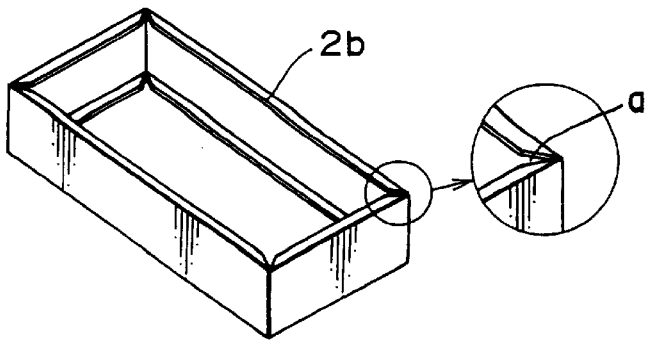
FIG. 3 is a perspective view of another example of the joint or connecting member with a partially enlarged view thereof.

However, by setting the rotary spring constant of the joint member 2 whose rotary axis extends along its length (the X axis in FIG. 2) to a value lower than the translational and rotary springs in all the other directions (K) θx<Kθy, Kθz, Kx, Ky, Kz in FIG. 2), the amount of bending moment produced at one plate which is to be transmitted to the other plate can be reduced. Therefore, even if a plurality of plates are arranged a short distance apart from each other, the sound insulation performance of the panel can be made closer to the value obtained by multiplying the sound insulation performance of a single plate constituting the panel with the number of such plates. To implement this, it is desirable to make Kθx of the joint member 2 sufficiently smaller than Kθy, Kθz, Kx, Ky, and Kz. This could be implemented, e.g., by providing the joint member 2 with a relatively thin opened cross section (e.g., a U-shaped cross section; see FIGS. 1A to 1C), by making the height of the joint member 2 (the distance between the plates 1 and 1) large, by giving the joint member 2 a shape other than the integrated frame-like body, by using a joint member 2*b* having slits a at its corners as shown in FIG. 3, or by joining the plates 1 and 1 through the joint member 2 while interposing a vibration-isolating material such as rubber between each plate 1 and the joint member 2. (Note that in FIG. 2, x denotes the longitudinal direction of the joint member 2 (the direction extending along a side of the plate); y the direction right angles to x and parallel with the surface of the plate 1; z the direction perpendicular to the surface of the plate 1; and Kθx, Kθy, Kθz, Kx, Ky, and Kz the rotary and translational springs in the respective directions).

Figure 4A:
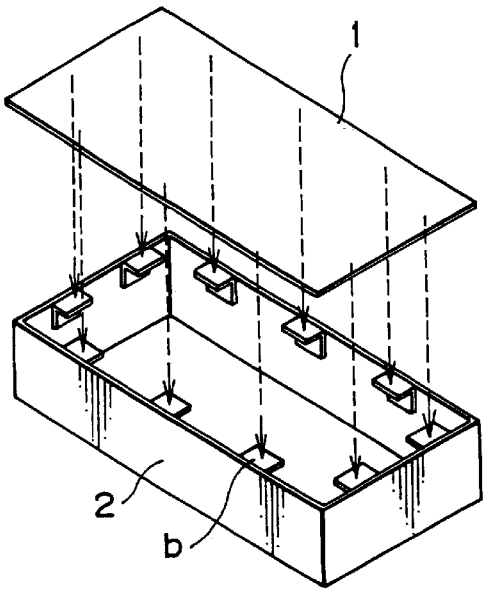
FIGS. 4A and 4B are diagrams for illustrating examples in each of which only the rotary spring constant of the joint member or the connecting member whose rotary axis extends in the longitudinal direction of each side thereof is zero.

Further, FIG. 4A shows an example for implementing a joint member whose Kθx is zero. The plate 1 is joined to the frame-like joint member 2 all along its periphery through hinges b, and the rotary spring constant of the joint member 2 is set to zero (while the translational and rotary springs in all the other directions have appropriate values).

Further, even if Kθx is decreased, when Kθy, Kθz, Kx, Ky, and Kz are increased to relatively larger values, the elastic deformation of the integrated panel 3 which is caused by the weight of the panel 3 when the panel 3 is suspended from above can be reduced to a considerable degree. In addition, the elastic deformation of the panel 3 which is caused by the loads to be applied when the panel 3 is manually moved after suspended can be reduced as well.

Still further, instead of joining the plates 1 and 1 through the frame-like joint member 2 all along their peripheries as shown in FIGS. 1A to 1C, the plates 1 and 1 are joined through the member 2 along only part of their peripheries (e.g., like the connecting members 4 shown in FIG. 1A) to thereby prevent the air from being enclosed within the closed space. Since this decreases the pneumatic spring constant of the air, those vibrations which are out of the vibrations caused at one plate and which the pneumatic spring transmits to the other plate can be reduced. As a result, the sound insulation performance of the panel is made further closer to the sound insulation performance obtained by multiplying the sound insulation performance of a single plate constituting the panel with the number of such plates.

The aforementioned relation between the plates 1, 1 and the joint member 2 applies in exactly the same way to that between the panels 3, 3 and the connecting member 4. That is, in the aforementioned multi-layered panel structure A, each panel 3 has the following sound insulation performance. When the distance between which the two panels 3 and 3 are arranged is short and the rotary spring constant (see FIG. 2; a rotary spring is Kθx with the X direction being the longitudinal direction of each side of the connecting member) of the connecting member 2 whose rotary axis extends in the direction of a side of the panel 3 (the longitudinal direction of the connecting member) is large, the bending moment produced by the bending vibrations at the peripheral portion of one of the panels (more correctly, one plate on the side of the connecting member out of the plates constituting such one of the panels) is transmitted to the other panel (more correctly, one plate on the side of the connecting member out of the plates constituting such other panel) by the rotary spring of the connecting member 4 through the connecting member 4. Since the vibrations at one panel are transmitted to the other through the connecting member 4 as described above, the sound insulation performance of the multi-layered panel structure is expressed in terms of a value lower than that obtained by simply multiplying (doubling) the sound insulation performance of a panel with the number of such panels.

However, by setting the rotary spring constant of the connecting member 4 whose rotary axis extends along its length (the X axis in FIG. 2) to a value lower than the translational and rotary springs in all the other directions (Kθx<Kθy, Kθz, Kx, Ky, Kz in FIG. 2), the amount of bending moment produced at one panel which is to be transmitted to the other panel can be reduced. Therefore, even if a plurality of panels are arranged a short distance apart from each other, the sound insulation performance of the multi-layered panel structure can be made closer to the value obtained by multiplying the sound insulation performance of each panel with the number of such panels. To implement this, it is desirable to make Kθx of the connecting member sufficiently smaller than Kθy, Kθz, Kx, Ky, and Kz. Conceivable specific means for implementing this may include, e.g., such shapes and connecting methods as described above with respect to the joint member.

Figure 4B:
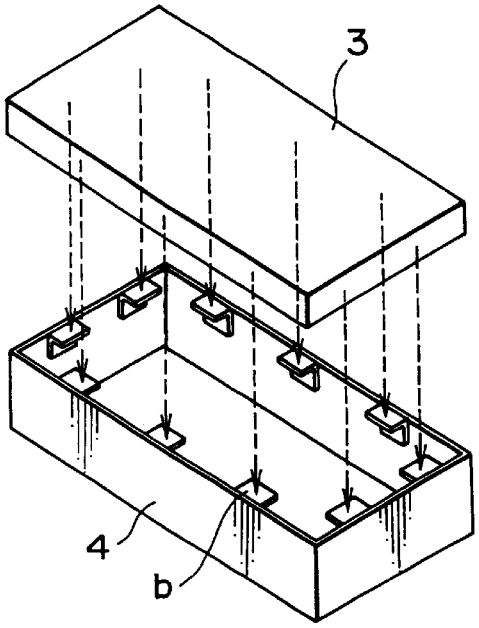

Similarly, FIG. 4B shows an example for implementing a connecting member whose Kθx is zero. The panel 3 is connected to the frame-like connecting member 4 all along its periphery through the hinges b, and the rotary spring constant of the connecting member 4 is set to zero (while the translational and rotary springs in all the other directions have appropriate values).

Further, even if Kθx is decreased, when Kθy, Kθz, Kx, Ky, and Kz are increased to relatively larger values, the elastic deformation of the integrated multi-layered panel structure which is caused by the weight of the structure when the structure is suspended from above can be reduced to a considerable degree. In addition, the elastic deformation of the multi-layered panel structure which is caused by the loads to be applied when the structure is manually moved after suspended can be reduced as well.

Still further, for uniting the panels 3 and 3 through the connecting member 4, the panels 3 and 3 are connected through the connecting members 4 along only part of their peripheries as shown in FIG. 1A (along only their shorter sides in FIG. 1A) to thereby prevent the air from being enclosed within the closed space. Since this decreases the pneumatic spring constant of the air, those vibrations which are out of the vibrations caused at one panel (more correctly, the plate on the side of the connecting member out of the plates constituting such one panel) and which the pneumatic spring transmits to the other panel (more correctly, the plate on the side of the connecting member out of the plates constituting such other panel) can be reduced. As a result, the sound insulation performance of the multi-layered panel structure is made further closer to the sound insulation performance obtained by multiplying the sound insulation performance of a single panel with the number of such panels.

Thus, when the spring constants in the respective directions shown in FIG. 2 are set so as to satisfy Kθx<Kθy, Kθz, Kx, Ky, Kz (more preferably K θx<<Kθy, Kθz, Kx, Ky, Kz) in either one or both of the joint member 2 and the connecting member 4. In the former case, the sound insulation performance of the panel can be made closer to the sound insulation performance obtained by multiplying the sound insulation performance of a single plate constituting the panel with the number of such plates, and in the latter case, the sound insulation performance of the multi-layered panel structure can be made closer to the sound insulation performance obtained by multiplying the sound insulation performance of a single panel with the number of such panels.

It is further desirable to set the rotary spring constant Kθx of the connecting member 4 whose rotary axis extends in the direction of the side of the panel 3 to a value smaller than the rotary spring constant Kθx of the joint member 2 whose rotary axis extends in the same direction, or to set the rotary spring constant Kθx of the joint member 2 whose rotary axis extends in the direction of the side of the plate 1 to a value smaller than the rotary spring constant Kθx of the connecting member 4 whose rotary axis extends in the same direction. Such settings aim to reduce the amount of transmission of the bending moment produced at one plate (or panel) to the other plate (or panel) by making the rotary spring constant Kθx of either the joint member 2 or the connecting member 4 smaller than that of the other member.

Next, other examples of multi-layered panel structures according to the present invention will be described with reference to FIGS. 5 to 16.

Figure 5:
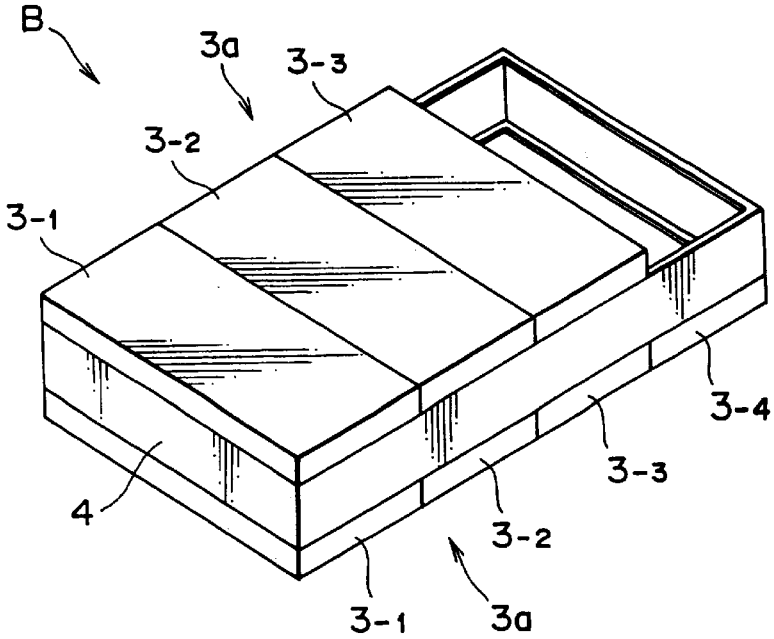
FIG. 5 is a perspective view showing a multi-layered panel structure in which a panel is constructed of a plurality of panel segments.

In a multi-layered panel structure of the present invention, one or more of a plurality of panels constituting the multi-layered panel structure may be made up of a plurality of panel segments. In this case, it is desirable to use a frame-like connecting member and to connect the panel segments to both surfaces of the connecting member along their peripheral portions. FIG. 5 shows such an example, which is a multi-layered panel structure B comprising two panels 3*a*, each being made up of a plurality of panel segments 3-1 to 3-4. Each of the panel segments 3-1 to 3-4 used in this multi-layered panel structure B is, similarly to the so far described panel 3, formed by arranging two plates at an interval in the direction of their thickness and joining these plates along their peripheries using a joint member. Two sets of such panel segments 3-1 to 3-4 forming two panels 3*a*, respectively, are connected to both surfaces of the frame-like connecting member 4, thereby providing a large area.

Figure 6A:
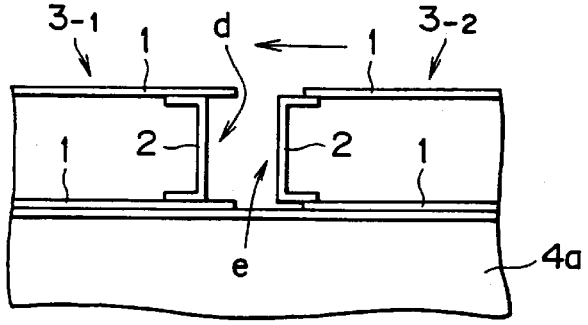
Figure 6B:
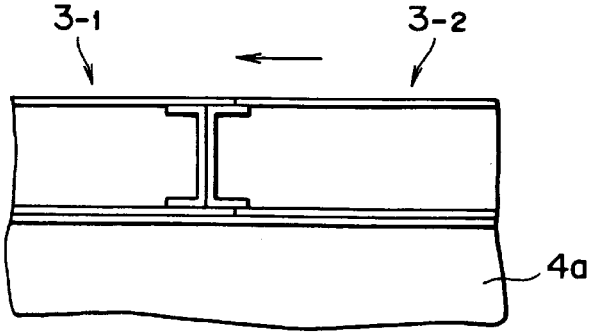

To join the panel segments 3-1 to 3-4 together firmly for forming the multi-layered panel structure B, the plates forming one of any two adjacent panel segments may, if necessary, be projected outward to thereby form a recess and the joint member of the other adjacent panel segment is projected outward from its plates to thereby form a projection, so that the projection is fitted into the recess, and it is preferable that with the projection fitted into the recess that way in every two adjacent panel segments, the panel segments are joined to the connecting member or their adjacent joint members are joined to each other. FIGS. 6A and 6B show such an example. A recess d is formed by projecting the plates 1 outward in the panel segment 3-1, while a projection e is formed by projecting the joint member 2 outward from the plates 1 in the panel segment 3-2. The projection e is designed to be fitted into the recess d.

Figure 7:
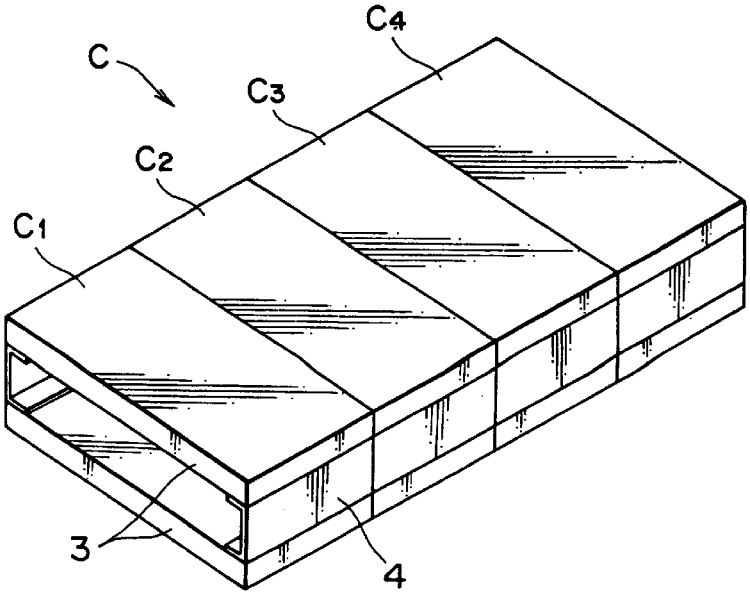
FIG. 7 is a perspective view showing a large-area multi-layered panel structure that is constructed by joining a plurality of small-area multi-layered panel structural bodies.

In a multi-layered panel structure of the present invention, a large-area multi-layered panel structure can be formed by arranging a plurality of small-area multi-layered panel structures contiguously planewise and by joining the adjacent joint members or/and connecting members together. FIG. 7 shows such an example, which is a multi-layered panel structure C having a large area. In the structure C, a plurality of multi-layered panel structural bodies C1 to C4 are arranged contiguously planewise and their adjacent joint members or/and connecting members are joined together. Here, each of the multi-layered panel structural bodies C1 to C4 is constructed of two panels 3 and connecting members 4 for connecting these panels 3 in a manner similar to the multi-layered panel structure shown in FIG. 1A.

Figure 8A:
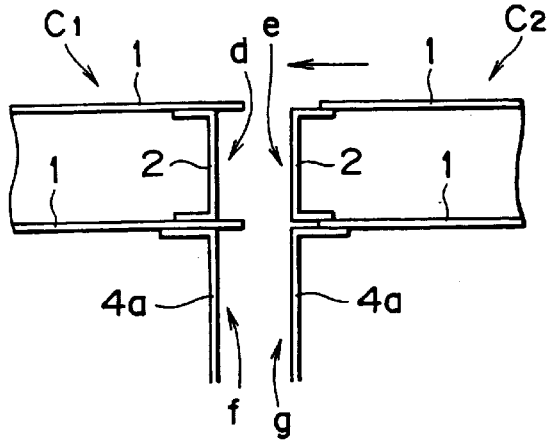
Figure 8B:
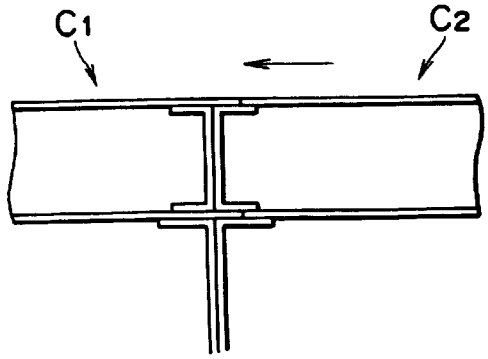

In order to join the multi-layered panel structural bodies C1 to C4 together firmly for forming the multi-layered panel structure C, the plates forming each panel of one of any two adjacent panel structural bodies may, if necessary, be projected outward from their joint member to thereby form a recess and the joint member of each panel of the other adjacent panel structural body is projected outward from its plates to thereby form a projection, so that the projection is fitted into the recess, and it is preferable that with the projection fitted into the recess that way in every two adjacent panel structural bodies, the adjacent joint members or/and connecting members are joined to each other. FIGS. 8A and 8B show such an example. Recesses d and f are formed by projecting the plates 1 outward in each panel 3 of the multi-layered panel structural body C1, while projections e and g are formed by projecting the joint member 2 and the connecting member 4*a* outward from the plates 1 in each panel of the multi-layered panel structural body C2. The projections are designed to be fitted into the corresponding recesses.

Further, the panels of any two adjacent panel structural bodies may be projected outward from their connecting member to thereby form a recess, and the connecting member of the other adjacent panel structural body may be projected outward from its panels to thereby form a projection.

Figure 9:
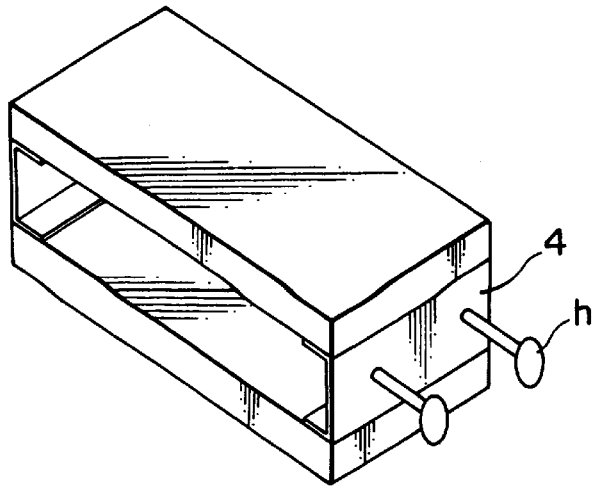
FIG. 9 is a perspective view showing a multi-layered panel structure in which projections for suspending the panel structure from above are attached to the connecting member.

In a multi-layered panel structure of the present invention, members for suspending the multi-layered panel structure from above may be attached to the joint member or/and the connecting member. FIG. 9 shows such an example, which is a multi-layered panel structure in which members (projections h in this example) for suspending the multi-layered panel structure from above are attached to one of the connecting members 4.

Further, when the multi-layered panel structure according to the present invention is suspended from above, a seal device may be attached to the joint member and/or the connecting member for closing the clearances formed with respect to the existing structures which extend above and below the multi-layered panel structure (e.g., the ceiling wall and the floor), or the joint member and/or the connecting member may double as such a seal device.

Still further, when the multi-layered panel structure according to the present invention is used so as to be arranged contiguously planewise, a seal device for closing the clearances formed between the horizontally adjacent multi-layered panel structures may be attached to the joint member and/or the connecting member, or the joint member and/or the connecting member may double as such a seal device.

Figure 10:
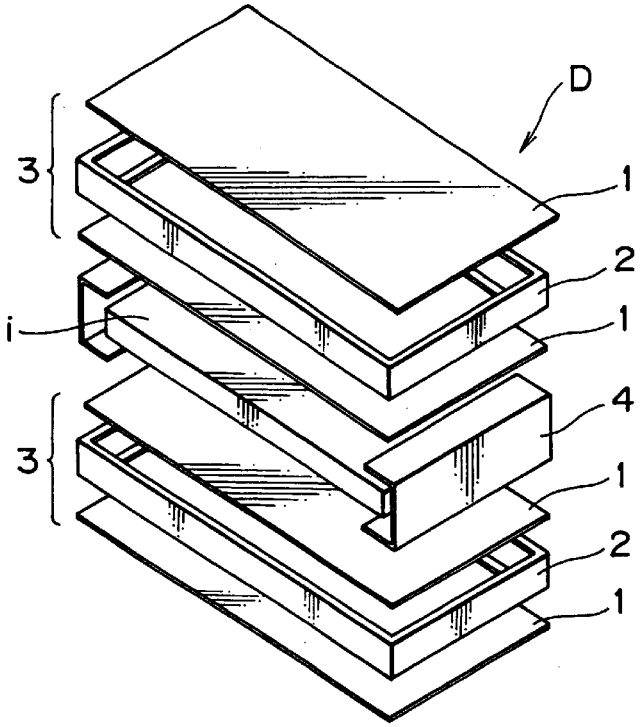
FIG. 10 is an exploded perspective view showing a multi-layered panel structure in which a sound-insulating material is provided in the air layer between the panels.

In a multi-layered panel structure of the present invention, a sound-absorbing material may be provided in at least one of the plurality of air layers (between the plates 1 and 1) to thereby improve its sound insulation performance. FIG. 10 shows such an example, which is a multi-layered panel structure D, in which a sound-absorbing material i is provided in the air layer between the panels 3 and 3 out of the plurality of air layers constituting the multi-layered panel structure. The sound-absorbing material i may also be arranged in the air layer within the panel 3. The sound-absorbing material i may include, e.g., those made of viscoelastic bodies having an open cell such as urethane foams and fibrous sound-absorbing materials such as glass wool. Using any of these materials, part of the energy of sound wave transmitted from one plate to the other via the air layer can be attenuated, thereby improving the sound insulation performance.

Further, when any such sound-absorbing material is brought into contact with one or both surfaces of the plates interposing the air layer therebetween (e.g., when the sound-absorbing material is squeezed into the space between the plates), vibrations of the plates can be suppressed, thereby allowing coincidence phenomena to be suppressed.

Figure 11:
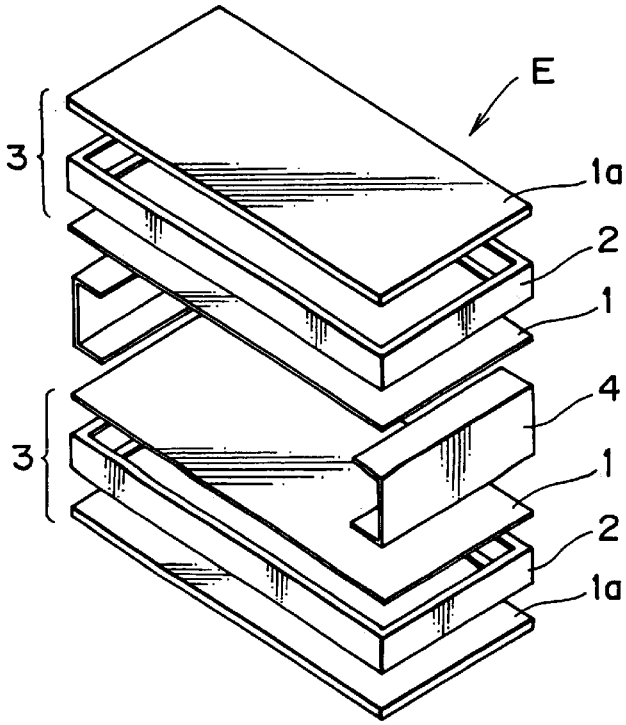
FIG. 11 is an exploded perspective view showing a multi-layered panel structure in which restricting type damping plates are used for the outer sides of the panels.

In a multi-layered panel structure of the present invention, a restraining type damping plate (the plate obtained by sandwiching a viscoelastic body between two plates) may be used for at least one of a plurality of plates constituting such multi-layered panel structure, or a viscoelastic body is stuck onto one surface of at least one of the plurality of plates, thereby allowing its damping action to damp the vibrations of the plates and improve the sound-insulating effect. FIG. 11 shows such an example, which is a multi-layered panel structure E, in which restraining type damping plates 1*a* are used as the outer plates of its panels 3 and 3.

In a multi-layered panel structure of the present invention, the plates constituting such multi-layered panel structure and their joint member, and/or the panels and their connecting member are united together through a vibration-isolating material. As a result of this construction, the rotary spring constant of the joint member (the rotary spring constant of the joint member whose rotary axis extends in the direction of a side of the plate) and/or the rotary spring constant of the connecting member (the rotary spring of the connecting member whose rotary axis extends along a side of the panel) can be reduced.

Figure 12:
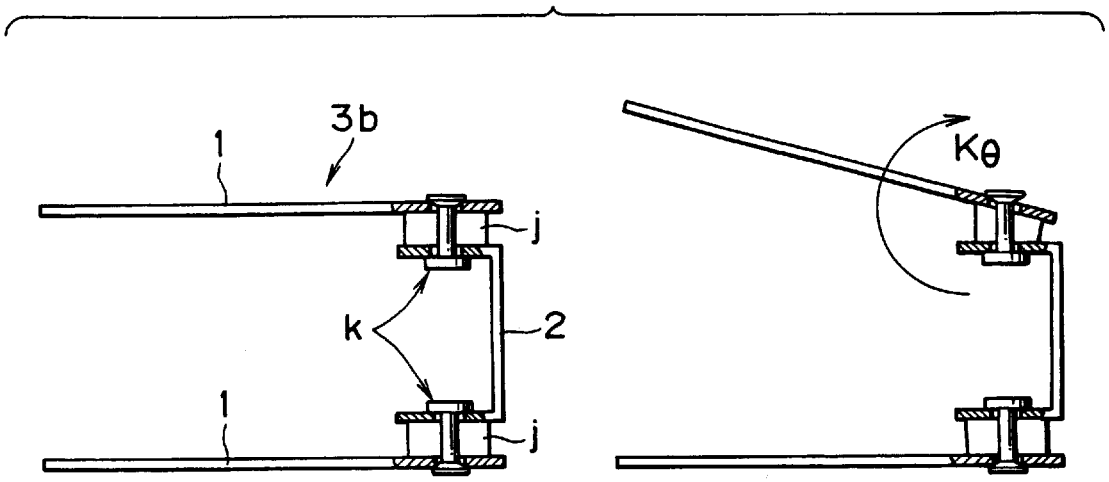
FIG. 12 is a sectional view of a panel in which a vibration-insulating material is interposed between a plate and a joint member.
Figure 13:
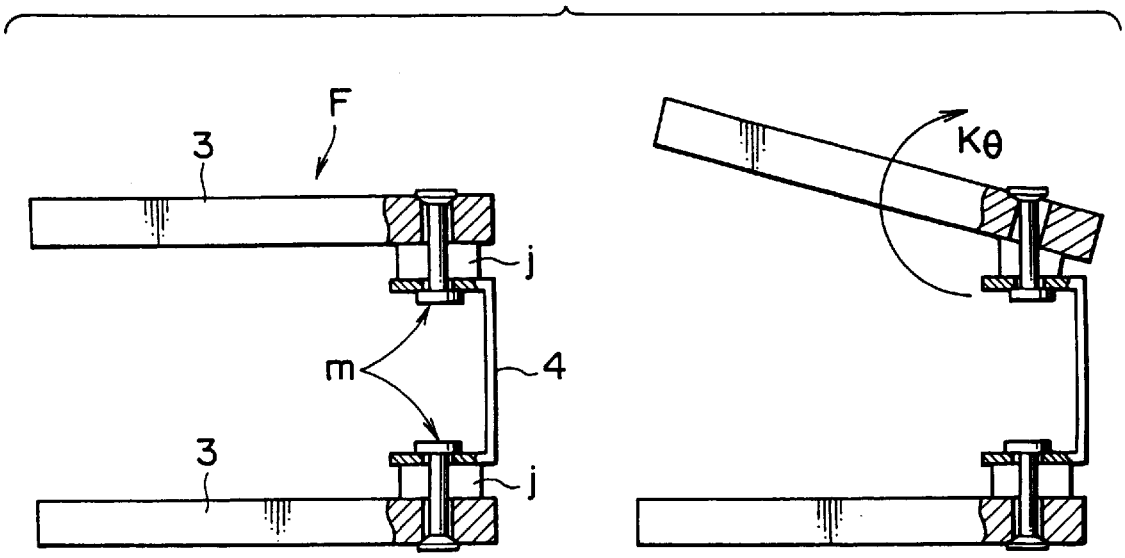
FIG. 13 is a sectional view of a multi-layered panel structure in which a vibration-isolating material is interposed between a panel and a connecting member.
Figure 14:
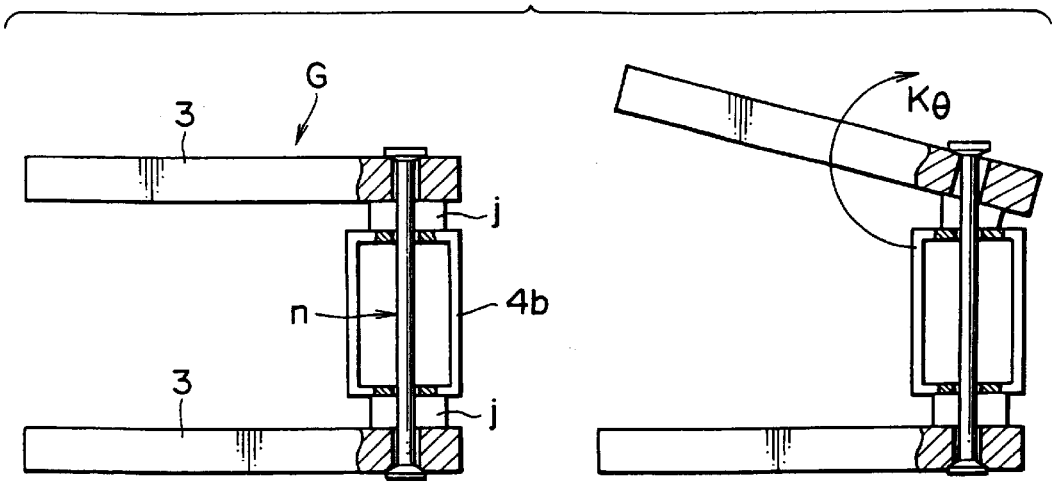
FIG. 14 is a sectional view of a multi-layered panel structure in which a vibration-isolating material is interposed between a panel and a connecting member.

FIG. 12 shows a panel 3*b* in which the joint member 2 that is U-shaped in cross section is used and two plates 1 and 1 are respectively joined with fixing pins k through elastic bodies j that are made of rubber or the like. In this structure, the rotary spring constant Kθ of the joint member 2 whose rotary axis extends in the direction of a side of the plate 1 (along the length of the joint member 2 in FIG. 12, or in the direction perpendicular to the sheet) decreases. FIG. 13 shows a multi-layered panel structure F in which the connecting member 4 that is U-shaped in cross section is used and two panels 3 and 3 are joined respectively with fixing pins m through the elastic bodies j. In this structure, the rotary spring constant Kθ of the connecting member 4 whose rotary axis extends in the direction of a side of the panel 3 (along the length of the connecting member 4 in FIG. 13, or in the direction perpendicular to the sheet) decreases. FIG. 14 shows a multi-layered panel structure G in which a connecting member 4*b* that is closed (box-shaped) in cross section is used and two panels 3 and 3 are joined respectively with a fixing pin n through the elastic bodies j. In this structure, the rotary spring constant Kθ of the connecting member 4*b* whose rotary axis extends in the direction of a side of the panel 3 (along the length of the connecting member 4*b* in FIG. 14, or in the direction perpendicular to the sheet) decreases. Owing to the use of the vibration-isolating material as in the multi-layered panel structure G, the connecting member (or the joint member, likewise), which has a closed cross section and thus would have an extremely large rotary spring constant with its axis extending in the longitudinal direction if the member were not provided with such a vibration-isolating material, can have the same rotary spring constant reduced to a smaller value.

Figure 15:
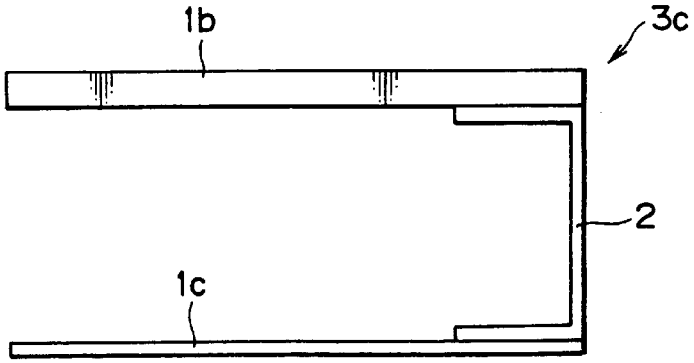
FIG. 15 is a sectional view of a panel in which two plates are set to different thickness.

In a multi-layered panel structure of the present invention, any two adjacent ones of a plurality of plates constituting the multi-layered panel structure are set to different thickness to thereby suppress coincidence phenomena. FIG. 15 shows such an example, which is a panel 3*c* in which a thick plate 1*b* and a thin plate 1*c* are joined using the joint member 2.

Figure 16:
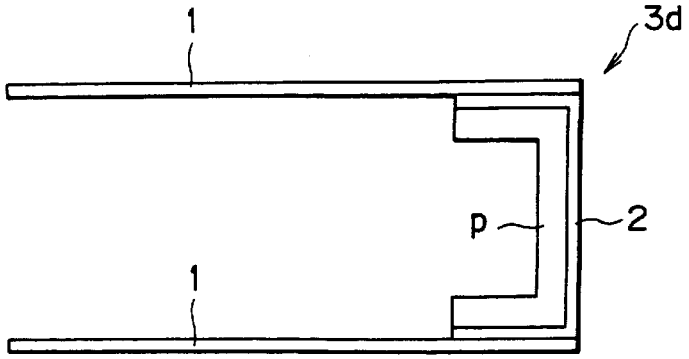
FIG. 16 is a sectional view of a panel in which a viscoelastic body is stuck to a joint member.

In a multi-layered panel structure of the present invention, the joint member or/and the connecting member for constituting the multi-layered panel structure are made of a restraining type damping plate, or a viscoelastic body is stuck to the joint member or/and the connecting member to thereby decrease the vibration transmission coefficient between adjacent plates owing to its damping action. FIG. 16 shows such an example, which is a panel 3*d*, in which the plates 1 and 1 are joined using the joint member 2 and a viscoelastic body p is stuck to the joint member 2.

EXAMPLES

Examples of the present invention will hereunder be presented.

Each of multi-layered panel structures (Examples 1 and 2) used here is a 150-mm-thick, 1-m-wide, 3-m-high rectangular parallelopiped (in terms of appearance) formed by connecting panels to both surfaces of a frame-like connecting member. Glass wool is used to fill in the air layer within the connecting member. Details of their components are shown in Table 1.

Figure 17:
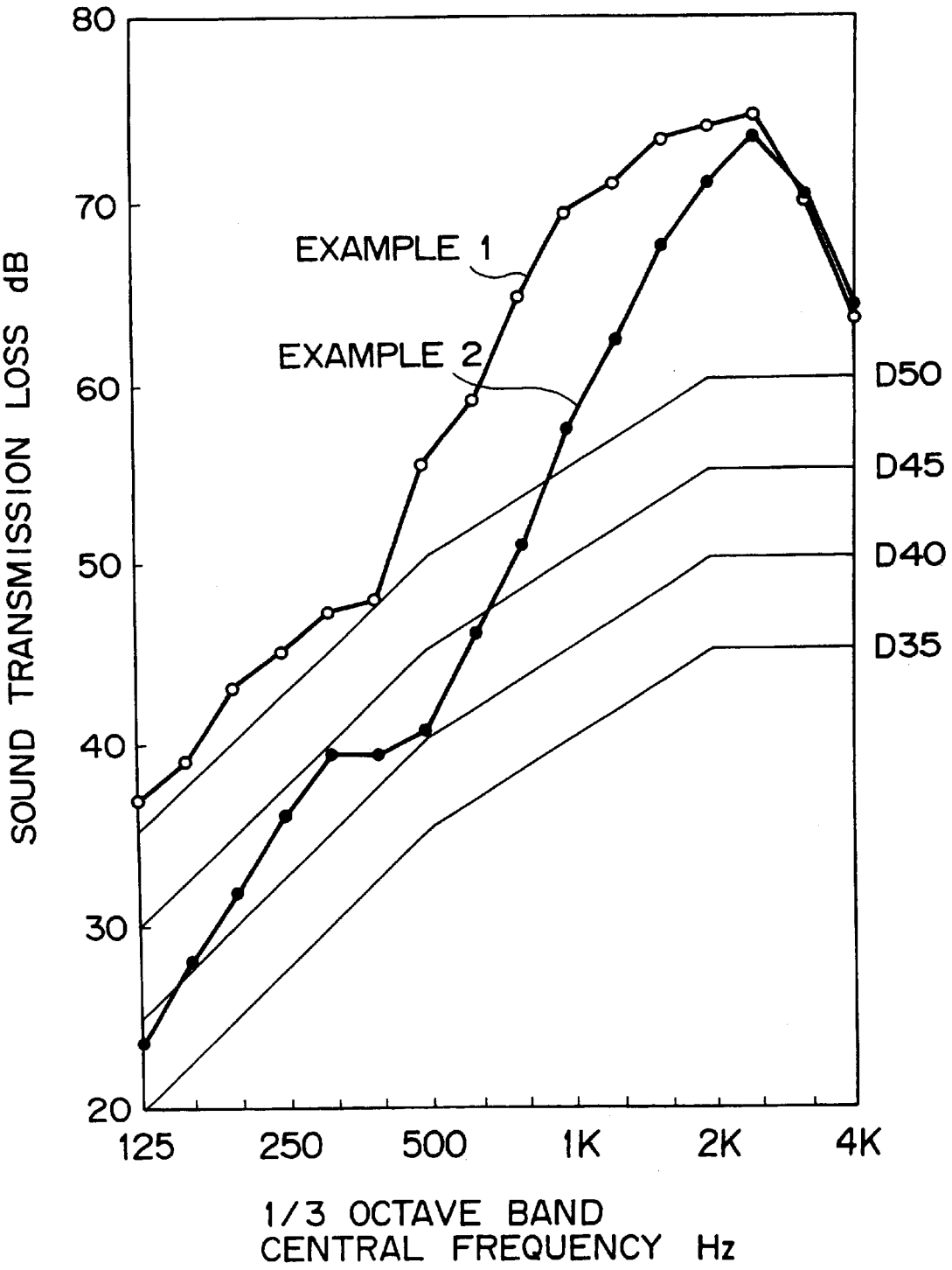
FIG. 17 is a diagram showing the sound insulation characteristics of multi-layered panel structures, which are examples.
Figure 18:
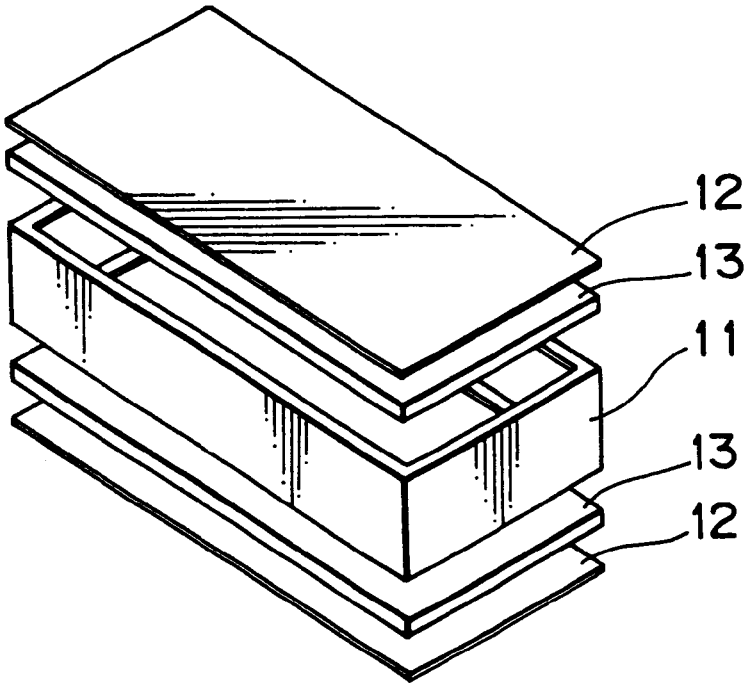
FIG. 18 PRIOR ART
FIG. 18 is a perspective view of a conventional partition wall panel.

For each of the multi-layered panel structures which are Examples 1 and 2, four panels are joined contiguously planewise with no gap to thereby form a 4-m-wide and 3-m-high partition. The sound transmission losses of each multi-layered panel structure with respect to one third octave band central frequency were measured based on the method specified in JIS (Japanese Industrial standard) A 1417. The results are shown in FIG. 17. Note that FIG. 17 also shows the lines indicating reference frequency characteristics for grades D35 to D50.

As shown in FIG. 17, the multi-layered panel structure, whose thickness is 150 mm and whose weight per unit area is 32.3 kg/m (Example 1), passed D50. Further, the multi-layered panel structure, whose thickness is 100 mm and whose weight per unit area is 20.0 kg/m (Example 2), passed D40.

TABLE 1

| | | |
|---|---|---|
| **Example 1** | | |
| Total size | | 150 mm (thickness ) × 1 m (width) × 3 m (height) |
| Weight | | 32.3 kg/m$^2$ |
| Plates | Outside of the panel | Restraining type damping plate formed by clamping a 100-$\mu$m-thick viscoelastic body between two 2-mm-thick aluminum plates |
| | Inside of the panel | 1-mm-thick aluminum plate |
| Joint member | | Made of 1-mm-thick aluminum plate, frame-like, box-shaped cross section (outside dimensions: 10 mm × 10 mm) |
| Connecting member | | Made of 1-mm-thick aluminum plate, frame-like, U-shaped cross section (Height of the web portion: 120 mm) |
| Sound-absorbing material | | 32 kg/m$^2$ |
| **Example 2** | | |
| Total size | | 100 mm (thickness) × 1 m (width) × 3 m (height) |
| Weight | | 20.0 kg/m$^2$ |
| Plates | Outside of the panel | 2-mm-thick aluminum plate |
| | Inside of the panel | 1-mm-thick aluminum plate |
| Joint member | | Made of 1-mm-thick aluminum plate, frame-like, box-shaped cross section (outside dimensions: 10 mm × 10 mm) |
| Connecting member | | Made of 1-mm-thick aluminum plate, frame-like, U-shaped cross section (Height of the web portion: 74 mm) |
| Sound-absorbing material | | 32 kg/m$^3$ |

We claim:

1. A partition wall panel comprising:

a panel being formed by arranging a plurality of plates at an interval in the direction of the thickness of the plates and joining the plates along at least part of the peripheries of the plates or/and at part of the surfaces of the plates using a joint member; and a connecting member for integrating a plurality of the panels by arranging the panels side by side through a plurality of air layers, and connecting the panels along at least part of the peripheries of the panels or/and at part of the surfaces of the panels.

2. A partition wall panel according to claim 1, wherein a rotary spring constant of the joint member whose rotary axis extends in the direction of a side of the plate is smaller than translational and rotary springs in all other directions in the panel.

3. A partition wall panel according to claim 1, wherein a rotary spring constant of the connecting member whose rotary axis extends in the direction of a side of the panel is smaller than translational and rotary springs in all other directions.

4. A partition wall panel according to claim 2, wherein the rotary spring constant of the connecting member whose rotary axis extends in the direction of the side of the panel is smaller than the rotary spring constant of the joint member whose rotary axis extends in the same direction.

5. A partition wall panel according to claim 2, wherein the rotary spring constant of the joint member whose rotary axis extends in the direction of the side of the plate is smaller than the rotary spring constant of the connecting member whose rotary axis extends in the same direction.

6. A partition wall panel according to claim 1, wherein the joint member or/and the connecting member constituting the partition wall panel has an opened cross section.

7. A partition wall panel according to claim 1, wherein the joint member is a frame-like joint member extending along the periphery of the plate, and the panel is integrated by joining the plates to both surfaces of the joint member along the peripheries of the plates.

8. A partition wall panel according to claim 1, wherein the connecting member is a frame-like connecting member extending along the periphery of the panel, and the partition wall panel is integrated by connecting the panels to both surfaces of the connecting member along the peripheries of the panels.

9. A partition wall panel according to claim 8, wherein at least one of the panels is constructed of a plurality of panel segments, and each panel segment has the same construction as that of the panel.

10. A partition wall panel according to claim 1, wherein adjacent joint members or/and connecting members are joined to give the partition wall panel a large surface.

11. A partition wall panel according to claim 1, wherein members for suspending the partition wall panel are attached to the joint member or/and connecting member.

12. A partition wall panel according to claim 1, wherein a sound-absorbing material is provided in at least one of the plurality of air layers constituting the partition wall panel.

13. A partition wall panel according to claim 12, wherein the sound-absorbing material is a sound-absorbing material made of a viscoelastic body having an open cell or a fibrous sound-absorbing material, and any such sound-absorbing material is brought into contact with one or both surfaces of the plates on both sides of the air layer.

14. A partition wall panel according to claim 1, wherein a restraining type damping plate is used as at least one of the plurality of plates constituting the partition wall panel, or the viscoelastic body is stuck to one surface of at least one of the plurality of plates.

15. A partition wall panel according to claim 1, wherein a vibration-isolating material is interposed between the plate and the joint member and/or between the panel and the connecting member constituting the partition wall panel.

16. A partition wall panel according to claim 1, wherein any two adjacent ones of the plurality of plates constituting the partition wall panel are set to different thickness.

17. A partition wall panel according to claim 1, wherein a restricting type damping plate is used as the joint member or/and the connecting member constituting the partition wall panel, or the viscoelastic body is stuck to the joint member or/and the connecting member.

18. A partition wall panel wherein a panel is formed by arranging a plurality of plates at an interval in the direction of the thickness of the plates and joining the plates along at least part of the peripheries of the plates or/and at part of the surfaces of the plates using a joint member, and a plurality of the panels are integrated while arranged side by side through a plurality of air layers, and connected to each other along at least part of the peripheries thereof or/and at part of the surfaces thereof using a connecting member.

* * * * *

UNITED STATES PATENT AND TRADEMARK OFFICE

CERTIFICATE OF CORRECTION

PATENT NO. : 6,112,851

DATED : September 5, 2000

INVENTOR(S): Akio SUGIMOTO, et al.

It is certified that an error appears in the above-identified patent and that said Letters Patent is hereby corrected as shown below:

On the title page, the Assignee's Name is Incorrect. It should read as follows:

[73] Assignee: Kabushiki Kaisha Kobe Seiko Sho (Kobe Steel, Ltd.)
Kobe, Japan

Signed and Sealed this

Fifteenth Day of May, 2001

*Attest:*

Nicholas P. Godici

NICHOLAS P. GODICI

*Attesting Officer*

*Acting Director of the United States Patent and Trademark Office*